US007451928B2

(12) United States Patent
Peterson

(10) Patent No.: US 7,451,928 B2
(45) Date of Patent: Nov. 18, 2008

(54) VERIFIABLE, AUDITABLE VOTING SYSTEM MAINTAINING VOTER PRIVACY

(76) Inventor: David W. Peterson, 1942 Rock Rest Rd., Pittsboro, NC (US) 27312

( * ) Notice: Subject to any disclaimer, the term of this patent is extended or adjusted under 35 U.S.C. 154(b) by 239 days.

(21) Appl. No.: 11/464,024

(22) Filed: Aug. 11, 2006

(65) Prior Publication Data

US 2008/0035728 A1 Feb. 14, 2008

(51) Int. Cl.
*G07C 13/00* (2006.01)

(52) U.S. Cl. ..... 235/386; 705/12

(58) Field of Classification Search ..... 235/386; 705/12

See application file for complete search history.

(56) References Cited

U.S. PATENT DOCUMENTS 6,679,970 B2 * 1/2004 Hwang ..... 156/277
6,726,090 B1 4/2004 Kargel
6,779,727 B2 * 8/2004 Warther ..... 235/462.01
6,817,515 B2 * 11/2004 Winnett ..... 235/51
6,865,543 B2 * 3/2005 Gibbs, Sr. ..... 705/12
6,968,999 B2 11/2005 Reardon
2003/0061092 A1 3/2003 Dutta et al.
2003/0158775 A1 8/2003 Chaum
2005/0284936 A1 12/2005 Pazniokas et al.

OTHER PUBLICATIONS

"International Search Report," International Application No. PCT/US07/75346, Jul. 14, 2008. European Patent Office, Rijswijk, Netherlands.

* cited by examiner

*Primary Examiner*—Jamara A Franklin
(74) *Attorney, Agent, or Firm*—Coats & Bennett, P.L.L.C.

(57) ABSTRACT

In a transparent election system that protects voter privacy, the actual votes cast are published as a public record, with individual voter information redacted, allowing verification of the election results. A voter may verify that his votes were properly read and counted, to a high degree of certainty. The voter retains a receipt, including a unique voterID, from his ballot. During verification, using the voterID, the voter receives a plurality of non-matching sets of votes, one of which is his, without any indication of which one that is. If a voter does not recognize his set of votes, his marked ballot may be physically audited by voterID. A third party may verify the election results using these verification and auditing procedures on randomly selected ballots or sets of votes from a database.

31 Claims, 3 Drawing Sheets

VERIFIABLE, AUDITABLE VOTING SYSTEM MAINTAINING VOTER PRIVACY

BACKGROUND

The present invention relates generally to the field of casting and counting votes in an election and in particular to a voting system wherein individual votes may be easily verified and audited while maintaining the secrecy of each voter's selections.

The 2000 U.S. presidential election in Florida demonstrated the fallibility and general unreliability of many deployed voting systems. Accurate, reliable vote reading and tallying systems are crucial for public confidence in election results, which is the ultimate bedrock of the legitimacy of government in a representative democracy. Following the Florida elections, Congress passed a law called the Help America Vote Act (HAVA) which appropriated $3.8 billion to replace punch-card and lever voting systems with computerized electronic voting systems. It is estimated that around 40 million votes were cast using electronic voting machines in the 2004 U.S. election. Electronic voting machines, however, are fraught with problems.

Many electronic voting machines capture voters' selections electronically, such as via touch-screen pads, and tally votes electronically. These machines do not generate an auditable paper trail. Without a voter-verifiable paper trail, proper auditing of results produced by the voting machine is difficult if not impossible. Since government agencies that purchase electronic voting machines are often denied access to the manufacturers' proprietary software, only the manufacturers can certify that the software counting the votes is completely bug-free, or that the machines are tamper-proof. Another problem with electronic voting machines is that election officials and poll workers may lack the technical skills to recognize anomalies, and may receive insufficient training in preparing, calibrating, certifying, operating, and troubleshooting the machines to ensure that they function as designed.

For example, six electronic touch-screen voting machines in Jackson and Wake counties, North Carolina, lost 436 ballots cast in early voting for the 2002 general election because of a software problem. As explained by the manufacturer, a programming glitch made the machines falsely sense that their memories were full. While the machines did display a brief error message, they continued to allow voters to cast votes—votes that were not recorded or added to the reported totals. The machines were new, and poll workers did not recognize that they were malfunctioning.

Election reform advocates generally agree on the need for a voter-verifiable, paper audit trail in voting systems. Various voting systems are known in the art by which a voter receives a receipt containing an identifier that allows the voter to later verify his vote, such as by entering the identifier into a web site published by the board of elections. However, these systems include no mechanism by which voter privacy is protected.

It has long been recognized that only when voters believe their votes are cast in secrecy, and that their privacy is maintained, is voting truly fair and free. Many voters may succumb to various sources of perceived pressure, rather than vote their true convictions, if they believe that their voting selections may become known, either generally or even by only one other person. Vote verification schemes that do not have specific measures in place to protect voter privacy will not be trusted.

SUMMARY

According to one or more embodiments of the present invention, the actual votes cast in an election are published as a public record, with individual voter information redacted. Any interested party may independently verify the election results by counting the actual votes. The system allows a voter to verify that the votes he cast were properly read and counted, to a high degree of certainty, while maintaining voter privacy. The voter retains a receipt detached from the ballot on which he marked his voting selections, the receipt including a unique voterID associated with the set of votes that the voter cast. Upon submitting the voter ID and a verification request, the voter is presented with a plurality of non-matching sets of votes, only one of which is his, without any indication of which one that is. In this manner, the voter may verify that his set of votes was accurately read and counted as it is one of the sets provided, but a third party who obtained the voter's voterID cannot ascertain with any degree of certainty which of the presented sets of votes were cast by the voter. The ballots are retained, allowing for audits of individual ballots if a voter does not recognize his set of votes among those presented during a verification, or for any other reason wishes to verify that his ballot was cast and counted. The system additionally allows for third-part certification of an election by performing verification and auditing procedures on randomly selected ballots or published sets of votes, respectively, to an arbitrary statistical probability of accuracy.

In one aspect, the present invention relates to a method of conducting an election. A plurality of ballots is provided, each ballot comprising a vote casting portion and a receipt portion, with a unique voterID printed on both the vote casting portion and the receipt portion. Unmarked ballots are distributed to voters. At least the vote casting portion of one marked ballot is received from each voter. A set of votes cast by each voter, as indicated by the marked ballot received from that voter, is recorded. The set of votes is associated with the voterID printed on the marked ballot received from that voter. The votes cast by all voters are tallied. Upon receiving a voterID and a request for a vote verification, the set of votes associated with the voterID and at least one non-matching set of votes are provided, without any indication of which set of votes is associated with the voterID.

In another aspect, the present invention relates to a method of conducting an election. A set of votes is received on a ballot from a voter. The voter is assigned a unique voterID. The ballot and the set of votes is associated with the voterID. Upon receiving a voterID and a request for a vote verification, the set of votes associated with the voterID and at least one non-matching set of votes are provided, without any indication of which set of votes is associated with the voterID.

In yet another aspect, the present invention relates to a transparent, verifiable voting system that protects voter privacy. The voting system includes a plurality of ballots, each ballot comprising a vote casting portion and a receipt portion, with a unique voterID printed on both the vote casting portion and the receipt portion. The voting system also includes a voting database containing sets of votes read from ballots marked by voters, each set of votes associated with the voterID printed on the ballot from which the votes were read. The voting system further includes a verification module accessing the voting database and operative to provide to a requesting voter presenting a voterID, a plurality of sets of votes, one of which is associated with the requesting voterID and operative to not provide any indication of which of the sets of votes is associated with the requesting voterID.

DETAILED DESCRIPTION

The Ballot

Figure 1:
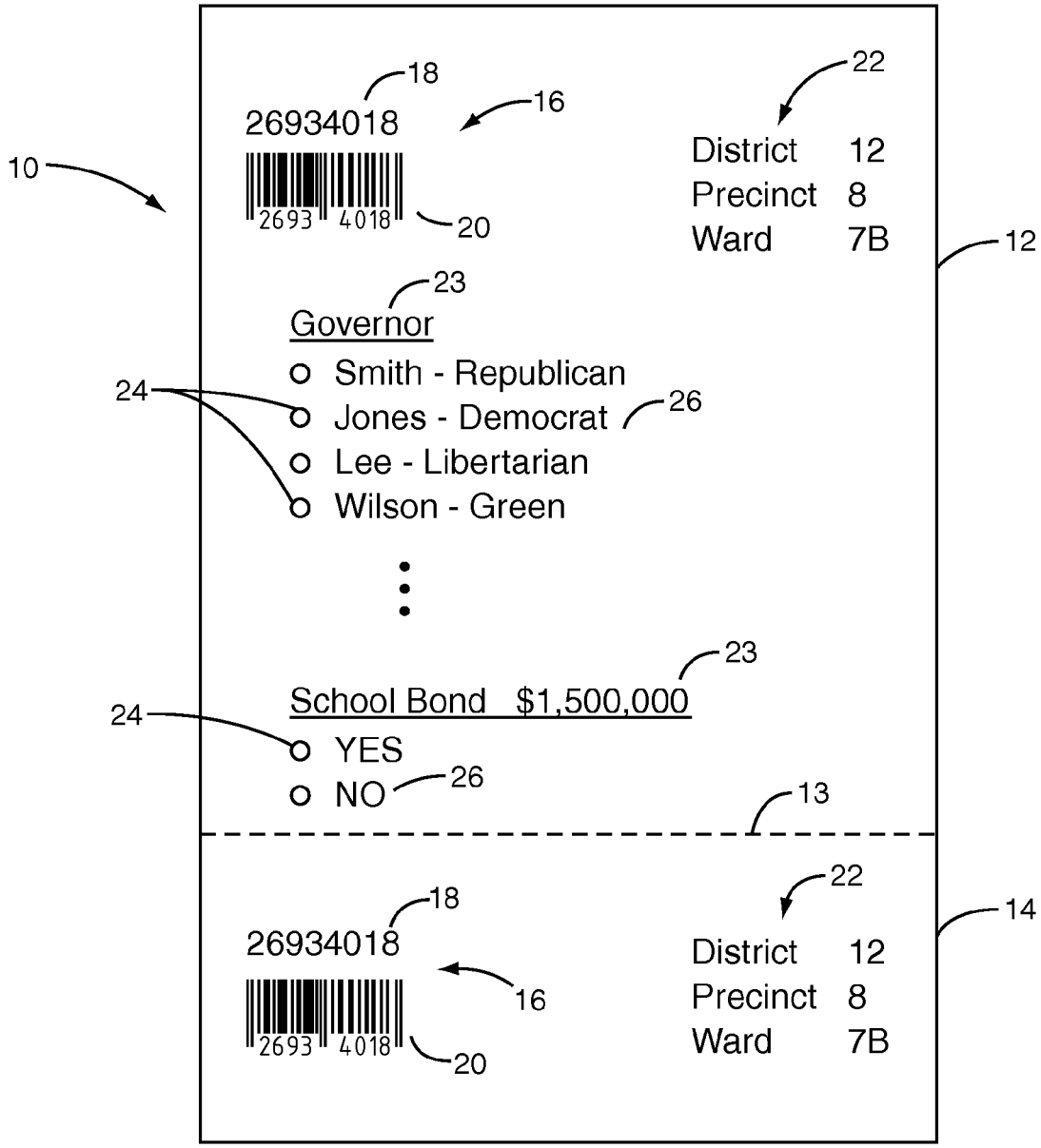
FIG. 1 depicts an optical scan election ballot.

FIG. 1 depicts a representative ballot, indicated generally at 10, for use in the voting system and method of the present invention. The ballot 10 includes a vote casting portion 12 and a receipt portion 14. The receipt portion 14 is removable from the ballot 10, such as by the provision of a perforation 13, allowing the received portion 14 to be easily separated from the ballot 10. A unique voterID 16 is printed on both the vote casting portion 12 and the receipt portion 14 of the ballot 10. The unique voterID 16 is printed in at least human-readable form 18 on the receipt portion 14, and in at least machine-readable form 20 (such as for example a barcode) on the vote casting portion 12. Preferably, the unique voterID 16 is printed in both human-readable form 18 and machine-readable form 20 on both the vote casting portion 12 and the receipt portion 14. Additional voting information 22, such as the voting district, precinct, ward, and the like, may also be printed on at least the vote casting portion 12, and preferably additionally on the receipt portion 14 of the ballot 10.

In the embodiment depicted in FIG. 1, the ballot 10 is an optically scanned ballot 10, and the vote casting portion 12 includes a marking area 24 by each candidate or choice 26 to be marked by a voter to indicate the voter's selection for each office or issue 23. In other embodiments, the ballot 10 may comprise a punch card with the voter punching out a chad to indicate each selection; a magnetically scanned ballot 10 where the voter indicates his selections with magnetic ink from a special pen supplied by election officials; or the like. In general, the ballot 10 may take any form and comprise any method—now known or yet to be developed—by which voters may indicate their voting selections and from which those selections are read from individual ballots 10 and tallied by elections officials. In a real-world election system, votes are preferably read from the ballot 10 automatically to facilitate counting a large number of ballots 10 in a reasonable time. However, the system and method of the present invention are fully applicable to hand-counted ballots 10.

The voterID 16 is preferably randomly distributed among ballots 10 prior to an election. The voterIDs 16 may be printed on the ballots 10 in a random order, or the ballots 10 may be shuffled prior to distribution to polling places. With randomly distributed voterIDs 16, the voterID 16 does not correlate to any property that would compromise voter privacy, such as precinct, time of day, or the like.

Voting

In an election, each voter is issued a single, unmarked ballot 10. The voter retires with the ballot 10 to a private booth or cubicle and marks his voting selections, generating a marked ballot 10. Prior to submitting the marked ballot 10 to election officials (or depositing it directly in a scanning machine), the voter may remove and retain the receipt portion 14. However, the receipt portion 14 need not be removed, if the voter remembers his voterID 16, or does not care to retain the ability to verify or audit his vote. Absentee ballots 10 are substantially similar, also comprising a vote casting portion 12 on which a voter marks his selections, and a receipt portion 14 that the voter removes prior to mailing in the ballot 10, and retains.

Figure 2:
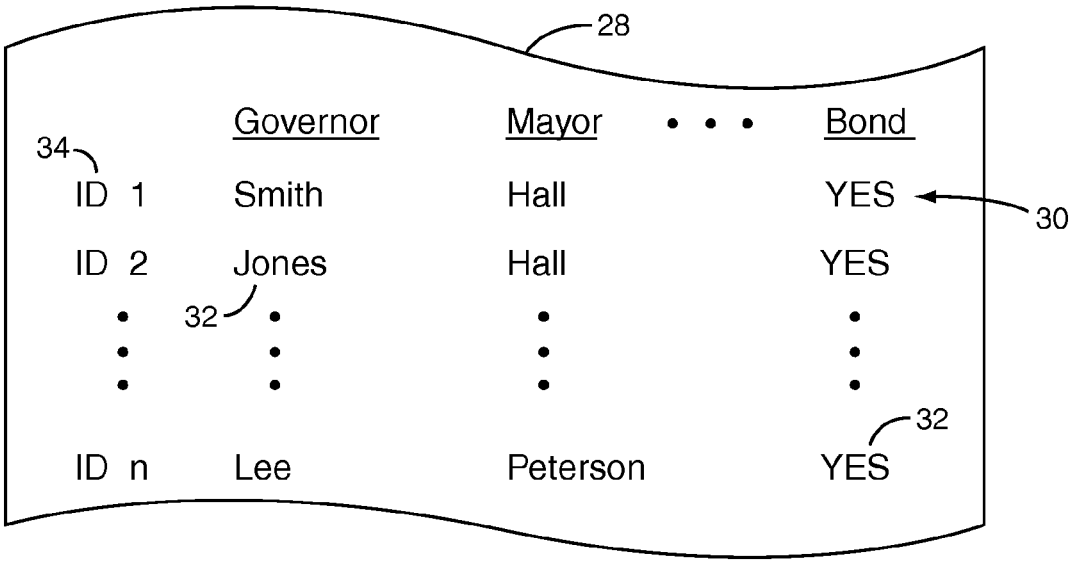
FIG. 2 depicts a voting database.
Figure 3:
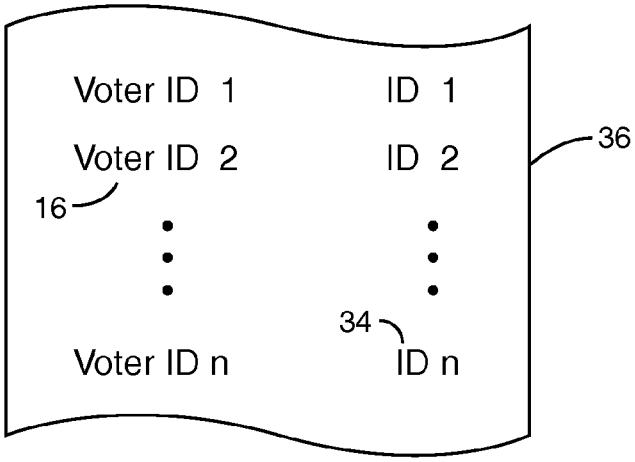
FIG. 3 depicts an identification database.
Figure 4:
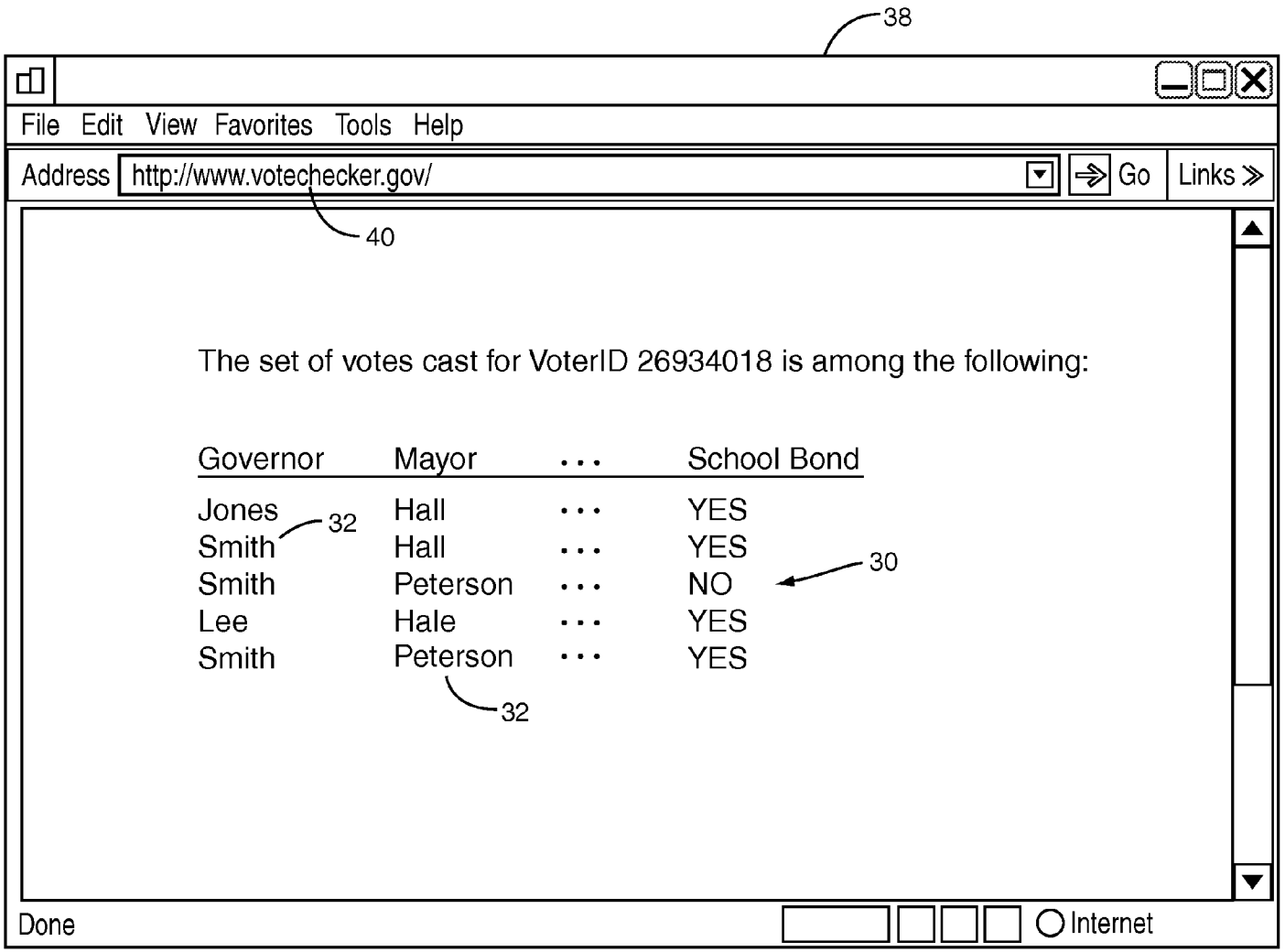
FIG. 4 depicts a browser displaying a vote verification web site.

The voter's set of votes are read from the ballot 10 and tallied with other voters' votes. In one embodiment, the set of votes from each voter is entered into a voting database, as depicted in FIG. 2. The database 28 of FIG. 2 may, for example, comprise a spreadsheet having one set 30 of votes 32 per row. As used herein, a set 30 comprises the one or more votes 32 cast by a single voter in a single election. The votes 32 may be recorded by name or YES/NO, as depicted in FIG. 2, or may otherwise be encoded in any form known in the art or yet to be developed. Associated with each set 30 of votes 32 is a unique identifier 34. In one embodiment, the unique identifier 34 comprises the voterID 16 read from the ballot 10. In another embodiment, the unique identifier 34 is associated with the voterID 16 in an identification database 36 that is separate from the voting database 28, as depicted in FIG. 3.

Vote Counting and Reporting

After the polls close, all votes 32 in the voting database 28 are tallied and reported. The voting database 28 is aggregated with voting databases 28 from other precincts, up to the appropriate jurisdictional or political hierarchy (e.g., county, state, etc.), and the votes 32 in the aggregate voting database 28 are tallied and reported.

At the appropriate level, the aggregate voting database 28, with the voterIDs 16 redacted to preserve voter privacy, is published as a public record. In the embodiment where the unique identifier 34 in the voting database 28 is the voterID 16, the unique identifier 34 field is hidden or expunged from the voting database 28 prior to publication. In the embodiment where the association between the unique identifier 34 in the voting database 28 and the voterID 16 is maintained in a separate identification database 36, the voterIDs 16 are inherently redacted from the voting database 28, which may be published directly. In either case, the redacted voting database 28—that is, without the voterIDs 16—may be distributed on CD-ROM, made available for downloading via the Internet, or the like. This allows any interested party to independently access the actual votes 32 of all voters, and to independently verify the election results by counting the votes (either by hand or with the use of a computer).

Additionally, the sets 30 of votes 32 may be data mined to uncover correlations, voting patterns, and similar information that may be of interest to political parties or social scientists. In one embodiment, redacted voting databases 28 at lower levels of aggregation (i.e., county, precinct, or the like) or covering different time periods (i.e., early voters, absentee voters, and election-day voters) may be published to facilitate voting pattern research. However, care should be taken that the minimum level of aggregation or duration is sufficiently large to capture enough sets 30 of votes 32 to make it statistically improbable that a particular set 30 of votes 32 can be associated with any individual. Publishing the actual—albeit anonymous—votes 32 for public inspection and independent verification increases the transparency of the election system, and thereby increases public confidence in it, particularly as compared to voting systems wherein votes are electronically tallied by secret, proprietary software and only a grand total is announced.

Vote Verification (Stage 1 Audit)

Publishing the redacted voting database 28 does not allow any individual voter to verify that his personal votes 32 were actually and accurately read and recorded. Each voter's set 30 of votes 32 may be retrieved from the non-redacted voting database 28 from his voterID 16 (either directly or via a preliminary lookup in the identification database 36). However, providing this capability to the general public would destroy voter privacy. Anyone who obtained a voter's voterID 16 would be able to discover how he voted.

Accordingly, the voting system and method of the present invention allows for each voter to verify that his votes 32 were properly counted (to a high degree of certainty) while maintaining voter privacy. This form of vote verification is also referred to herein as a Stage 1 Audit, as it is generally the first step in a full audit of a voter's ballot 10, as described more fully herein. FIG. 3 depicts an Internet web browser window displaying a web site identified by a URL 40, such as http://www.votechecker.gov (which, for the purpose of this disclosure, is synonymous with the web site itself). The web site 40 may be the mechanism by which the redacted voting database 28 is published, and may provide tools for statistical analysis of the votes 32 in the redacted voting database 28. In one embodiment, the web site 40 additionally provides a means by which individual voters may verify that their votes 32 were properly recorded.

At an appropriate page of the web site 40, a voter may enter the voterID 16 from the receipt portion 14 retained from his ballot 10. The web site 40 then displays at least two (and preferably a programmable number, such as five or more) non-matching sets 30 of votes 32, one of which is associated with the voter's voterID 16. The voter's set 30 of votes 32 and the other sets 30 of votes 32 are preferably displayed in random order. The voter may peruse these sets 30 of votes 32, and satisfy himself that one of them corresponds to his recollection of the votes 32 that he cast. However, no one other than the voter is able to ascertain the voter's votes 32, even if he obtains the voter's voterID 16.

In one embodiment, where the unique identifier 34 in the non-redacted voting database 28 is the voterID 16, a plurality of others sets 30 of votes 32 may be obtained by truncating one or more digits of the voterID 16, and retrieving the sets 30 of votes 32 associated voterIDs 16 that match the truncated voterID 16. For a decimal representation of the voterID 16, this operation could retrieve ten sets 30 of votes 32—one associated with the requesting voterID 16, and nine others. A software check may ensure that none of the sets 30 of votes 32 match, or that at most a predetermined number of them match. If too many of the sets 30 of votes 32 match, the another digit of the requesting voterID 16 may be truncated, a larger plurality of sets 30 of votes 32 retrieved, and a predetermined number of non-matching sets 30 displayed.

In another embodiment, such as where the unique identifier 34 differs from the voterID 16 in the voting database 28, one or more non-matching sets 30 of votes 32 may be selected at random from the voting database 28, and displayed along with the set 30 of votes 32 associated with the requesting voter ID 16. In still another embodiment, software may simply create non-matching sets 30 of votes 32 at random, and display them along with the set 30 of votes 32 associated with the requesting voterID 16. In one embodiment, the software may create non-matching sets 30 of votes 32 according to an algorithm that correlates votes 32 within a set as to political party or the like, to generate more "realistic" sets 30 than may result from random selection.

Vote Audit (Stage 2)

In the event that a voter examines the sets 30 of votes 32 presented, and is confident that none of them match the way he voted, the voter may request an audit from election officials. The voter presents the receipt portion 14 of his ballot 10, which contains the voterID 16. Using the voterID 16, election officials may retrieve the corresponding vote casting portion 12 of the voter's marked ballot 10 to verify the actual votes 32 cast, and may then access the non-redacted voting database 28 to verify that the votes 32 were properly read from the marked ballot 10 and recorded.

If the voterID 16 was printed on at least the vote casting portion 12 of the ballot 10 in machine-readable form 20, automated handling equipment may be used to sift through a large number of marked ballots 10 to locate the ballot containing the requesting voter's voterID 16. Alternatively, automated sorting equipment may be used to sort marked ballots 10 following the election, to facilitate the location of audited ballots 10 by election workers. As yet another alternative, the vote casting portion 12 of each ballot 10 may be stamped at the time it is cast with a Filing Sequence Number, and a data base constructed that pairs this Filing Sequence Number with the voterID 16. Ballots 10 may then be filed and stored by the Filing Sequence Number, and expeditiously retrieved in an audit by converting the voterID 16 to its corresponding Filing Sequence Number.

If sufficient vote reading and/or recording errors are discovered during one or more audits, the marked ballots 10 may be re-scanned as part of a recount. In fact, votes 32 on the marked ballots 10 may be counted by hand, if necessary. Retention of actual voter-marked ballots 10, and the ability of any voter to retrieve and view his ballot and compare it with its representation in a public data base, are critical to the integrity of the voting system, and are necessary for complete public confidence in that system.

Third Party Audit

The paper ballot 10 marked with voterID 16 and the public database of votes cast of the voting system of the present invention enable and facilitate a comprehensive third party audit that ensures voting accuracy to an arbitrary statistical probability. The third-party audit can proceed by randomly selecting a predetermined number n of cast paper ballots 10, and performing a Stage 1 Audit on each. In particular, the voter ID 16 is retrieved from each selected ballot 10, and the corresponding set 30 of votes 32 is retrieved from the voting database 28 (either directly, or via a preliminary look up in the identification database 36). The votes 32 recorded in the voting database 28 are compared to the cast ballot 10 to ensure that the votes 32 were accurately read and recorded.

Alternatively, the third-party audit may proceed by randomly selecting a predetermined number n of the sets 30 of votes 32 from the voting database 28, along with the corresponding unique identifier 34. The unique identifier 34 is converted, if necessary, to the corresponding voterID 16, and a Stage 2 Audit is performed on each voterID 16. In particular, the vote casting portion 12 of the paper ballot 10 corresponding to the voterID 16 is retrieved, and compared to the votes 32 obtained from the voting database 28, to verify that each ballot 10 was accurately read and its votes 32 properly recorded.

In either case, there is no way for the third party performing the audit to associate any voter with any voterID 16, thus voter privacy is preserved throughout the third-party audit. The third-party audits can verify the results of an election to an arbitrary degree of accuracy. Based on standard statistical sampling theory, by auditing a sample of n ballots 10 (or alternatively, n sets 30 of votes 32), the probability is at least P that the proportion J_Pi of all ballots cast that were cast in favor of item J on the ballot is within the range of J_Pi_Low to J_Pi_High, where J, P, and the difference J_Pi_Interval=J_Pi_High—J_Pi_Low are specified in advance of the sample size n being determined and of the sample being drawn.

Although the present invention has been described herein with respect to particular features, aspects and embodiments thereof, it will be apparent that numerous variations, modifications, and other embodiments are possible within the broad scope of the present invention, and accordingly, all variations, modifications and embodiments are to be regarded as being within the scope of the invention. The present embodiments are therefore to be construed in all aspects as illustrative and not restrictive and all changes coming within the meaning and equivalency range of the appended claims are intended to be embraced therein.

What is claimed is:

1. A method of conducting an election, comprising:

providing a plurality of ballots, each ballot comprising a vote casting portion and a receipt portion, with a unique voterID printed on both the vote casting portion and the receipt portion;

distributing unmarked ballots to voters;

receiving at least the vote casting portion of one marked ballot from each voter;

recording a set of votes cast by each voter as indicated by the marked ballot received from that voter;

associating the set of votes with the voterID printed on the marked ballot received from that voter;

tallying the votes cast by all voters; and upon receiving a voterID and a request for a vote verification, providing the set of votes associated with the voterID and at least one set of votes that does not match the set of votes associated with the verification-requesting voterID, without any indication of which set of votes is associated with the verification-requesting voterID.

2. The method of claim 1 wherein the voterID is printed in machine-readable form on at least the vote casting portion of each ballot.

3. The method of claim 2 further comprising:

receiving the receipt portion of a ballot and a request for an audit;

reading the voterID from the receipt portion of the ballot;

retrieving the ballot via the voterID on the vote casting portion thereof; and providing the vote casting portion of the ballot to the requesting voter.

4. The method of claim 3 wherein retrieving the ballot via the voterID on the vote casting portion thereof comprises:

mechanically processing a plurality of ballots;

machine reading the voterID from the vote casting portion of each ballot; and providing of the ballot whose voterID matches the requesting voterID.

5. The method of claim 3 further comprising, prior to receiving a request for an audit, mechanically sorting a plurality of ballots by the voterID on the vote casting portion thereof, to facilitate the retrieval of a particular ballot by a human.

6. The method of claim 1 wherein the voterID is printed in human-readable form on at least the receipt portion of each ballot.

7. The method of claim 1 wherein the voterID is printed in both human-readable form and machine-readable form on both the vote casting portion and the receipt portion of each ballot.

8. The method of claim 1 wherein recording a set of votes cast by each voter as indicated by the marked ballot received from that voter comprises optically scanning the marked ballot.

9. The method of claim 1 wherein associating the set of votes with the voterID printed on the marked ballot received from that voter comprises:

adding the set of votes to a voting database;

associating the set of votes with a unique identifier in the voting database; and associating the unique identifier with the voterID.

10. The method of claim 9 wherein associating the unique identifier with the voterID comprises adding the unique identifier and the voterID to an identification database that is separate from the voting database.

11. The method of claim 9 further comprising, after tallying the votes, publishing a subset of the voting database that does not include the voterIDs.

12. The method of claim 9 wherein providing the set of votes associated with the voterID and at least one set of votes that does not match the set of votes associated with the verification-requesting voterID, without any indication of which set of votes is associated with the verification-requesting voterID, comprises:

randomly selecting at least one set of votes from the voting database;

comparing the randomly selected set of votes to the set of votes associated with the verification-requesting voterID;

if necessary, randomly selecting another set of votes associated with a different voterID until a set of votes is selected that does not match the set of votes associated with the verification-requesting voterID.

13. The method of claim 12 wherein providing at least one set of votes that does match the set of votes associated with the verification-requesting voterID comprises providing a predetermined number of sets of votes, none of which match the set of votes associated with the verification-requesting voterID.

14. The method of claim 9 wherein the unique identifier is the voterID.

15. The method of claim 14 wherein the voting database comprises a spreadsheet with one voterID and associated set of votes per row.

16. The method of claim 14 wherein providing the set of votes associated with the voterID and at least one set of votes that does not match the set of votes associated with the verification-requesting voterID, without any indication of which set of votes is associated with the verification-requesting voterID, comprises:

truncating a digit of the voterID;

retrieving all sets of votes associated with the truncated voterID;

comparing all retrieved sets of votes with the set of votes associated with the requesting voterID; and if more than a first predetermined number of the retrieved sets of votes match the set of votes associated with the requesting voterID, successively truncating additional digits from the truncated voterID and retrieving more sets of votes until a second predetermined number of sets of votes, none of which match the set of votes associated with the verification-requesting voterID, are retrieved.

17. The method of claim 9 wherein providing the set of votes associated with the voterID and at least one set of votes that does not match the set of votes associated with the verification-requesting voterID, without any indication of which set of votes is associated with the verification-requesting voterID, comprises randomly generating the at least one set of votes that does not match the set of votes associated with the verification-requesting voterID.

18. The method of claim 1 wherein receiving a voterID and a request for a vote verification comprises providing a web site and receiving a voterID and a request for a vote verification electronically.

19. The method of claim 18 wherein providing the set of votes associated with the voterID and at least one set of votes that does not match the set of votes associated with the verification-requesting voterID comprises providing the sets of votes via the web site.

20. A method of conducting an election, comprising:

receiving a set of votes on a ballot from a voter;

assigning the voter a unique voterID;

associating the ballot and the set of votes with the voterID;

upon receiving a voterID and a request for a vote verification, providing the set of votes associated with the voterID and at least one set of votes that does not match the set of votes associated with the verification-requesting voterID, without any indication of which set of votes is associated with the verification-requesting voterID.

21. The method of claim 20 wherein the set of votes that does not match the set of votes associated with the verification-requesting voterID is associated with a voterID other than the verification-requesting voterID.

22. The method of claim 20 wherein the set of votes that does not match the set of votes associated with the verification-requesting voterID is generated randomly in response to the request.

23. The method of claim 20 wherein the sets of votes are provided in random order.

24. The method of claim 20 further comprising, upon receiving a voterID and a request for an audit, providing the ballot to the voter for verification.

25. The method of claim 20 wherein the ballot comprises a vote casting portion and a receipt portion;

the voterID is printed on both the vote casting portion and the receipt portion;

the voter removed and retained the receipt portion prior to submitting the ballot; and wherein receiving a voterID and a request for an audit comprises receiving the receipt portion of the ballot.

26. The method of claim 25 wherein the voterID is printed on at least the vote casting portion of the ballot in machine readable form.

27. A transparent, verifiable voting system that protects voter privacy, comprising:

a plurality of ballots, each ballot comprising a vote casting portion and a receipt portion, with a unique voterID printed on both the vote casting portion and the receipt portion;

a voting database containing sets of votes read from ballots marked by voters, each set of votes associated with the voterID printed on the ballot from which the votes were read; and a verification module accessing the voting database and operative to provide to a requesting voter presenting a voterID, a plurality of sets of votes, one of which is associated with the verification-requesting voterID and operative to not provide any indication of which of the sets of votes is associated with the requesting voterID.

28. The voting system of claim 27 wherein the voting database does not include voterIDs, and wherein the voting database is a public record.

29. The voting system of claim 27 wherein the verification module comprises software.

30. The voting system of claim 29 wherein the verification software is accessed via an Internet web site.

31. The voting system of claim 27 further comprising an audit module receiving the receipt portion of a ballot and providing the corresponding vote casting portion of the ballot.

* * * * *